US006758793B2

(12) United States Patent
Eldridge

(10) Patent No.: US 6,758,793 B2
(45) Date of Patent: Jul. 6, 2004

(54) SPORTS AND RECREATION APPARATUS

(76) Inventor: Scott Eldridge, 22180 Grove Park Dr., Santa Clarita, CA (US) 91350

( * ) Notice: Subject to any disclaimer, the term of this patent is extended or adjusted under 35 U.S.C. 154(b) by 0 days.

(21) Appl. No.: 09/991,586

(22) Filed: Nov. 17, 2001

(65) Prior Publication Data

US 2003/0017917 A1 Jan. 23, 2003

Related U.S. Application Data

(60) Provisional application No. 60/253,608, filed on Nov. 27, 2000.

(51) Int. Cl.[7] ..... A63B 26/00

(52) U.S. Cl. ..... 482/77; 482/15; 482/78

(58) Field of Search ..... 482/15, 27–29, 482/77, 78, 123, 126, 148

(56) References Cited

U.S. PATENT DOCUMENTS 3,195,890 A * 7/1965 Salls ..... 482/128
3,751,032 A * 8/1973 Boyle ..... 482/77
3,773,320 A * 11/1973 Samiran et al. ..... 482/77
3,929,329 A * 12/1975 Rivera ..... 482/71
4,730,826 A * 3/1988 Sudmeier ..... 482/71
5,374,225 A * 12/1994 Wilkinson ..... 482/27
5,634,870 A * 6/1997 Wilkinson ..... 482/30
5,921,899 A * 7/1999 Rose ..... 482/112
6,390,956 B1 * 5/2002 Seelye et al. ..... 482/77
6,419,611 B1 * 7/2002 Levine et al. ..... 482/53

OTHER PUBLICATIONS

Hester, Ann; Togo stick reinvented to bounce up on air; The San Diego Union–Tribune; Aug. 30, 2001; section E, pp. E7.

* cited by examiner

*Primary Examiner*—Danton D. DeMille
*Assistant Examiner*—Tam Nguyen
(74) *Attorney, Agent, or Firm*—Steven M. Freeland

(57) ABSTRACT

A method and apparatus for allowing a user to repetitively bounce into the air, includes a first and second support, each having a first and second end. A base being coupled to the first and second supports at the second ends. At least one compression resistance system being coupled with the base. The compression resistance system is configured to provide an uncompression force. First and second handles being coupled with the first ends of the first and second supports, respectively. When in use a user stands on the base between the first and second support and provides a first force on the apparatus. The user releases the first force and receives a second force. The user then stops exerting the second force and repeats the steps of providing the first force, releasing the first force and receiving the uncompression force.

12 Claims, 10 Drawing Sheets

SPORTS AND RECREATION APPARATUS

PRIORITY

The present application claims priority to and incorporates the following Application by reference: SPORTS AND RECREATION APPARATUS, U.S. Provisional Patent Application No. 60/253,608, filed on Nov. 27, 2000.

TECHNOLOGY FIELD

This invention pertains to a method and apparatus for recreational and sporting activities, and more particularly to a method and apparatus for vaulting a user into the air.

BACKGROUND

A pogostick is well known in the art. However, the pogostick puts the user in danger of injury due to the placement of the vertical support. Traditional pogosticks present unneeded risk of injury to the chest, neck and face, as the vertical support is positioned along the midline of the body.

Traditional pogosticks are unstable and difficult to operate due to its non-adjustable nature. Further, traditional pogosticks are limited in the amount of motion and dynamic exercise they allow users.

SUMMARY

The present invention advantageously addresses the needs above as well as other needs by providing an apparatus for continuously or repeatedly bouncing or being vaulted into the air comprising: a first support and a second support; a base having a first end and a second end, wherein the first end of the base is fixed with a second end of the first support and the second end of the base is fixed with a second end of the second support; and a compression resistance system secured with the base, and the compression resistance system being configured to provide an uncompression force.

In another embodiment, the invention provides an apparatus for allowing a user to bounce. The apparatus comprising: a base having a first end and a second end; the first end of the base being coupled with a second region of a first support; the second end of the base being coupled with a second region of a second support, wherein the first support and the second support are coupled with the base such that a first region of the first support is a distance from a first region of the second support; and a second end of the first support being coupled with a first compression resistance system configured to provide an uncompression force.

In another embodiment, the invention provides a method for allowing a user to repetitively bounce. The method comprising: standing on a base between a first and second support; providing a first force on a compression resistance system; releasing the first force; receiving an uncompression force; repeating the steps of providing the first force, releasing the first force and receiving the uncompression force.

In another embodiment, the invention provides a method and apparatus for allowing a user to continuously or repetitively bounce or to be vaulted into the air, includes at least a first and second support, wherein each of the first and second supports have a first and second end. A base is coupled to each of the second ends of the first and second supports, and at least one compression resistance system is coupled with the base. The compression resistance system is configured to provide compression resistance when the apparatus is in use. A first handle couples with the first end of the first support and a second handle couples with the first end of the second support. When in use a user stands on the base between the first and second support, balances on the apparatus and then provides a first force on the compression resistance system. The user then releases the first force and exerting a second force on at least one of the plurality of handles such that the second force is in the opposite direction as the first force. The user then stops exerting the second force and repeats the steps of providing the first force and releasing the first force.

BRIEF DESCRIPTION OF THE DRAWINGS

The invention, together with further advantages thereof, may best be understood by reference to the following description taken in conjunction with the accompanying drawings in which.

DETAILED DESCRIPTION

Figure 1:
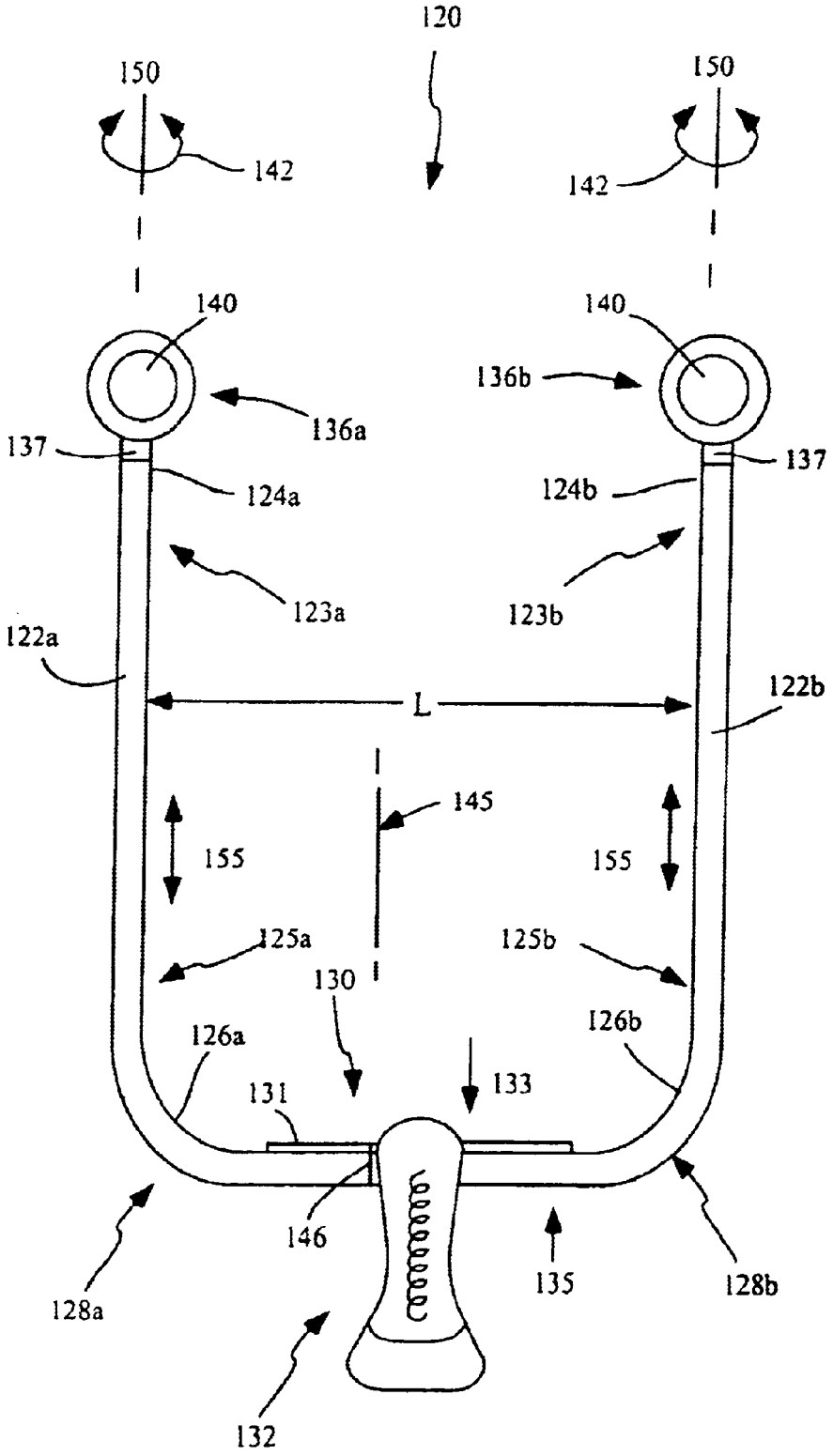
FIG. 1 shows a simplified schematic diagram of one implementation of one embodiment of the novel apparatus of the present invention where the apparatus is configured in generally a "U" shape.

FIG. 1 shows a simplified schematic diagram of one implementation of one embodiment of the novel apparatus 120 of the present invention. In one embodiment, the present apparatus 120 is configured in generally a "U" shape. The U-shaped embodiment of the apparatus 120 includes a first and second support 122*a–b*. The first support 122*a* has a first region 123*a*, a first end 124*a*, a second region 125*a*, and second end 126*a*. The second support 122*b* has a first region 123*b*, a first end 124*b*, a second region 125*b*, and second end 126*b*. The base 130 of the "U" shaped apparatus 120 is fixed to both the first and second supports 122*a–b* at the second ends 126*a–b*, respectively. The supports are secured to the base such that they are separated from one another by the length L of the base. In one embodiment, the base 130 is rigidly fixed with the supports 122*a–b* to prevent movement or separation of the supports from the base. The base is fixed to both supports 122*a–b* through substantially any method including, but not limited to, welding, threaded mounting, riveting, bolting, latching, snap fit, and substantially any other method for securing known in the art. In one embodiment, the supports 122*a–b* and the base 130 are a single, continuous piece. As such, no method for securing is needed to maintain the positioning of the base relative to the supports.

The base 130 can include a flat portion (not shown) providing a position for the user to stand. The base can have substantially any shape, including circular, oval, square, rectangular and substantially any other shape where a flat surface is provided for the user to stand. Alternatively, the base can include a foot support or foot plate 131 secured with the base. The foot support 131 allows the use to easily stand on the apparatus. The foot support 131 can be a single piece or separate pieces, for example on for each foot.

In one embodiment, the base 130 is configured to support the feet of a user or users. The base 130 is configured to have a sufficient length L to separate the first and second supports 122*a–b* by a distance sufficient to allow a user to stand between the first and second supports 122*a–b*. However, it will be apparent to one skilled in the art that the dimensions of the base 130 can be varied to provide a width for different sized users without departing from the novelty of the present invention. In one embodiment, the base 130 is a separate component from the supports 122*a–b* and coupled at a first side 128*a* of the base with the second end 126*a* of the first support 122*a* and at a second side 128*b* of the base 130 to the second end 126*b* of the second supports 122*b*.

Still referring to FIG. 1 the apparatus 120 further includes at least one compression resistance system 132. The compression resistance system 132 is secured with the base 130. The compression resistance system 132 is rigidly fixed with the base 130 to prevent movement or separation of the compression resistance system from the base. The compression resistance system 132 is fixed to the base 130 through substantially any method including, but not limited to, welding, threaded mounting, riveting, bolting, latching, snap fit, and substantially any other method for securing known in the art. In one embodiment, at least a portion of the compression resistance system 132 is a continuous extension of the base 130. The compression resistance system 132 is configured to resist compression. As such, if a user asserts a sufficient compression force 133 on the base 130 the compression resistance system 132 will compress. Once the user halts the asserted compression force the compression resistance system 132 exerts an expansion or uncompression force 135 opposite that of the compression force thus uncompressing the compression resistance system 132 and propelling the user in the direction of the uncompression force 135.

The compression resistance system 132 can be configured to include one or more of substantially any compression resistant devices including a spring or springs, one or more hydraulic compression resistance elements, a gas or liquid filled ball, and substantially any other compression resistance element known in the art or substantially any combination of compression resistant devices. The compression resistance system 132 can also include a plurality of individual compression resistant devices such as springs or hydraulic compression resistance elements. The compression resistance system 132 can also be scalable allowing the addition or removal of individual compression resistance elements or increasing or decreasing tension or pressure of the compression resistance system. For example, the compression resistance system 132 may include one or more compression springs where one or more springs can be added or removed depending on desired compression resistance. As another example, the compression resistance system may include a pressure cylinder which compresses air or other gases within the chamber upon compression, where the pressure within the chamber can be adjusted by adding or removing air. This scalability allows the apparatus 120 to be set at varying degrees of compression resistance providing varying degrees of compression resistance and thus varying degrees of uncompression force 135. This varying degree of compression resistance provides several advantages, for example, allowing different users of different weights to utilize the same apparatus. Further, the scalable compression resistance allows users of various skill levels to utilize the same apparatus. For example, lower skilled users can use the compression resistance system 132 with less resistance allowing easier use, while users of greater skill levels can utilize the compression resistance system 132 with increased resistance to obtain greater uncompression force resulting in greater bounce and lift. The compression resistance system 132 can also be replaceable. The scalable and replaceable compression resistance systems both allows for the apparatus 120 to be operated at varying degrees of compression resistance and also allows for the replacement of a worn or damaged compression resistance system 132.

In one embodiment, the apparatus 120 further includes first and second handles 136*a–b*, each coupled with or a continuous piece of first and second supports 122*a–b*, respectively. In one embodiment, the handles 136*a–b* are secured with the supports 122*a–b* to prevent separation of the handles from the supports. The handles are fixed to both supports 122*a–b* through substantially any method including, but not limited to, welding, threaded mounting, riveting, bolting, latching, snap fit, and substantially any other method for securing known in the art. Handles 136*a–b* allow a user to grip the apparatus 120 to maintain contact with the apparatus 120 during use and provide enhanced stability. The handles 136*a–b* shown in FIG. 1 are generally circular in shape with an inner gap or aperture 140 allowing the user to grip the handles 136*a–b*. It will be apparent to one skilled in the art that the shape of the handles 136*a–b* can be altered without departing from the novelty of the invention.

In one embodiment, handles 136*a–b* are rotationally coupled with supports 122*a–b* to allow the handles 136*a–b* to rotate in relation to the axis 150 of the supports 122*a–b* as is designated by the arrows labeled 142. The rotational coupling allows the handles 136*a–b* to be rotated to various positions with respect to the axes 150 of the supports 122*a–b*. In one embodiment, the handles 136*a–b* each include a compression locking system 137. The compression locking system 137 is configured to release and allow the handles 136 to rotate around the support axis 150 when a force is applied to the handles in a direction away from the base 130, and to lock preventing rotation of the handles, when the force away from the base is no longer applied to the handles. Alternatively, compression locking system 137 locks and prevents the handles 136 from rotating around the axis 150 when a force in the direction towards the base is applied, and release allowing the handles to rotate about the axis 150 when the force towards the base is no longer applied.

In one embodiment, the supports 122*a–b* are adjustable along the axis 150, as designated by arrows 155, to allow the handles to be moved closer to or way from the base. This allows the apparatus 120 to have varying heights. This allows a single apparatus to be utilized by a plurality of users of different heights or allow adjustments for preferred positioning or to perform different maneuvers or tricks. The adjustability is obtained through substantially any means for providing an extension and contraction of a rod or beam including, but not limited to, button and hole adjusting system, mating screw threading and substantially any other method for providing adjustment.

In one embodiment, the apparatus 120 includes one or more joints, pivots or hinges 146. The hinge is incorporated within the base 130. The hinge 146 allows the apparatus to fold about an axis 145 allowing a reduction in size for storage and transport. The hinge 146 is configured to lock at least in the open position when the apparatus 120 is in use.

Figure 2:
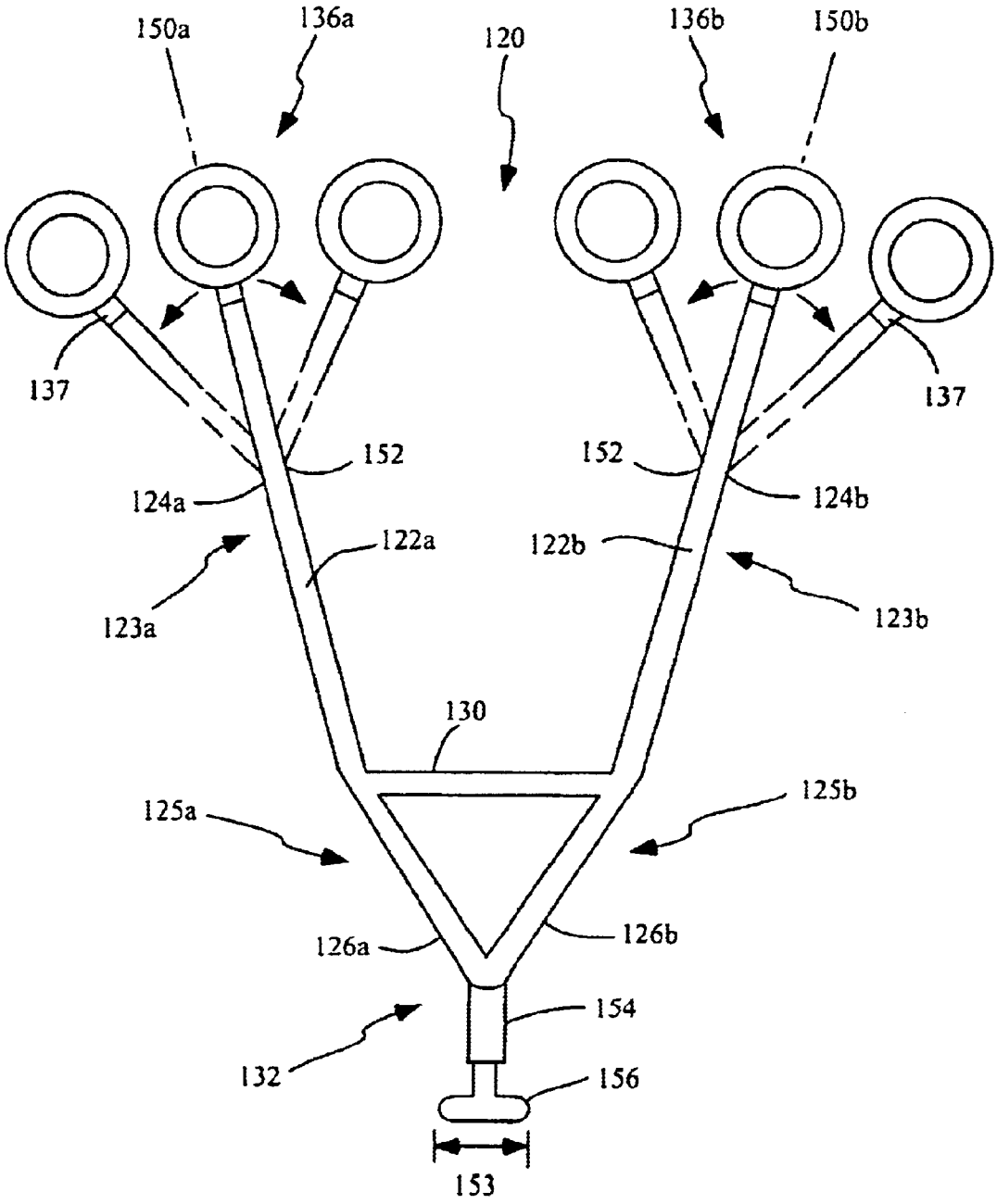
FIG. 2 shows a simplified schematic drawing of one implementation of one embodiment of the present apparatus, where the apparatus is configured in generally an up-side-down "A" shape.

FIG. 2 shows a simplified schematic drawing of one implementation of one embodiment of the present apparatus 120, where the apparatus 120 is configured in generally an up-side-down "A" shape. As such, the two supports 122*a–b* are coupled together at the second ends 126*a–b* and angle away from each other along the supports. The angle is sufficient such that the first regions 123*a–b* of the first and second supports are at a sufficient distance apart to provide spacing between the first and second support to allow a user to be positioned between the supports. The supports 122*a–b* further couple with the compression resistance system 132 at the second ends 126*a–b*. Base 130 couples between supports 122*a–b* to support the user during operation. The base 130 is coupled to the both supports 122*a–b* proximate the second regions 125*a–b* of the supports 122*a–b*, respectively. The base 130 is configured with a sufficient length to allow a user to position both feet on the base between the supports 122*a–b*. First and second handles 136*a–b* are pivotally and rotationally coupled with first and second supports 122*a–b* at the first ends 123*a–b*, respectively. The rotational coupling allows the handles 136*a–b* to be rotated to various positions with respect to the axes 150 of the supports 122*a–b*. The pivotal coupling 152 allows the user to position the handles 136*a–b* at one of a plurality of desired positions for comfort, enhanced stability and for varied uses, such as for performing various tricks. In one embodiment, the pivoting allows the handles to be pivoted from side to side increasing or decreasing the distance between the handles. The pivoting can additionally or alternately be in a forward and backward direction (into and out of the page as shown in FIG. 2). In the embodiment shown in FIG. 2, the compression resistance system 132 includes a gas, hydraulic compression resistance unit 154. The compression resistance system can be configured to allow the pressure within the hydraulics to be increased and decreased for increased and decreased compression resistance. A protection stopper 156 is coupled with the compression resistance system 132 providing an impact region for the apparatus 120 to impact the ground or other surface upon which the apparatus is being operated. The protection stopper 156 additionally provides protection to the compression resistance system 132 and apparatus 120. The protection stopper 156 is constructed of rubber, plastic, silicon and substantially any other material known the art providing sufficient flexibility and compression strength. In one embodiment, the protection stopper 156 is configured to provide a wider contact point 153 with the surface upon which the apparatus contacts during use to provide enhanced stability, easier use and simplified balancing of the apparatus 120. In one embodiment, the protection stopper 156 is removable to allow different sized contact points 153 and thus allowing users of different skill levels to use the same apparatus or to replace the protection stopper 156 if warn or damaged.

Figure 3A:
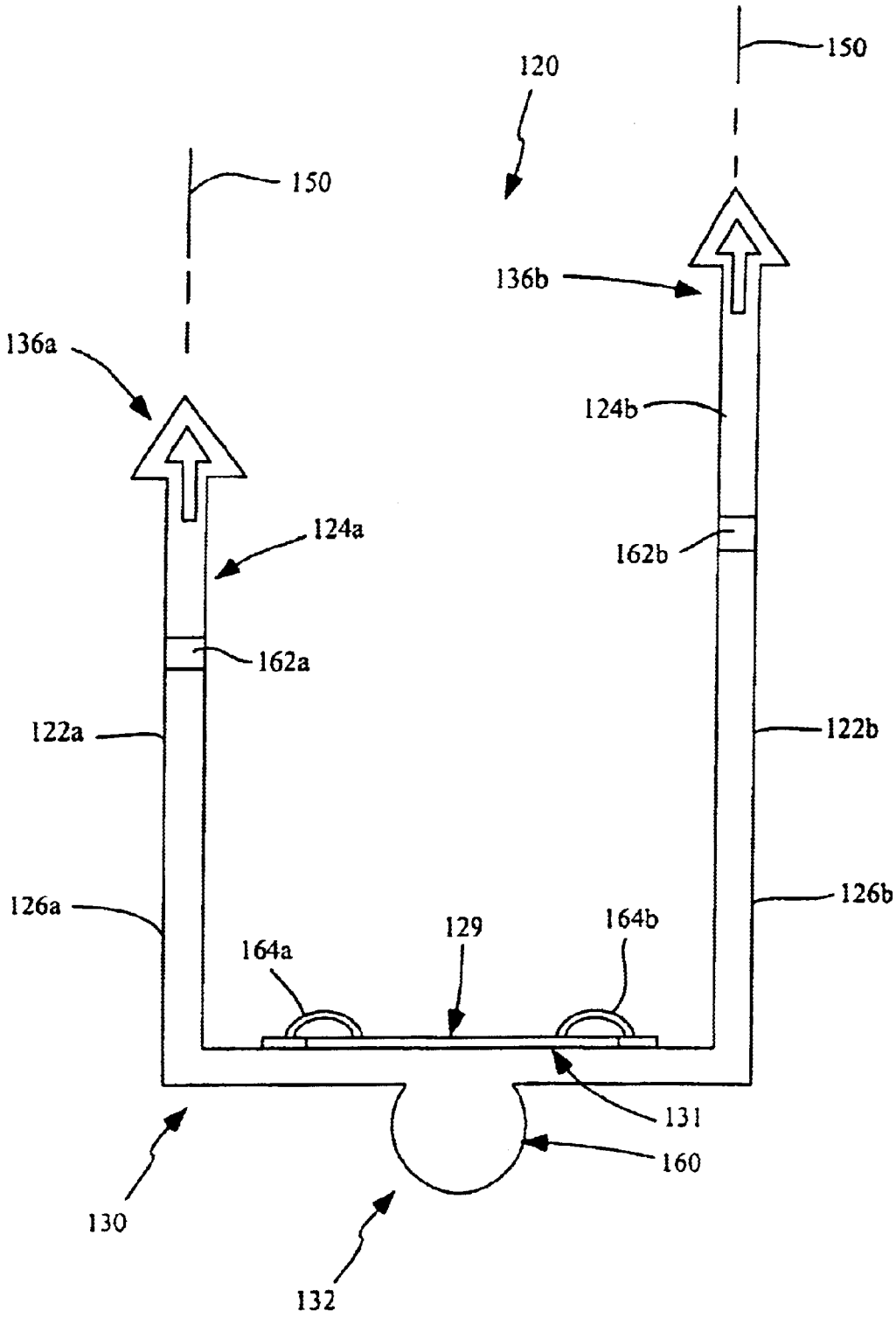
FIGS. 3A and 3B show simplified schematic drawings of two alternate embodiments of the novel apparatus where the apparatus has a generally open square shape.
Figure 3B:
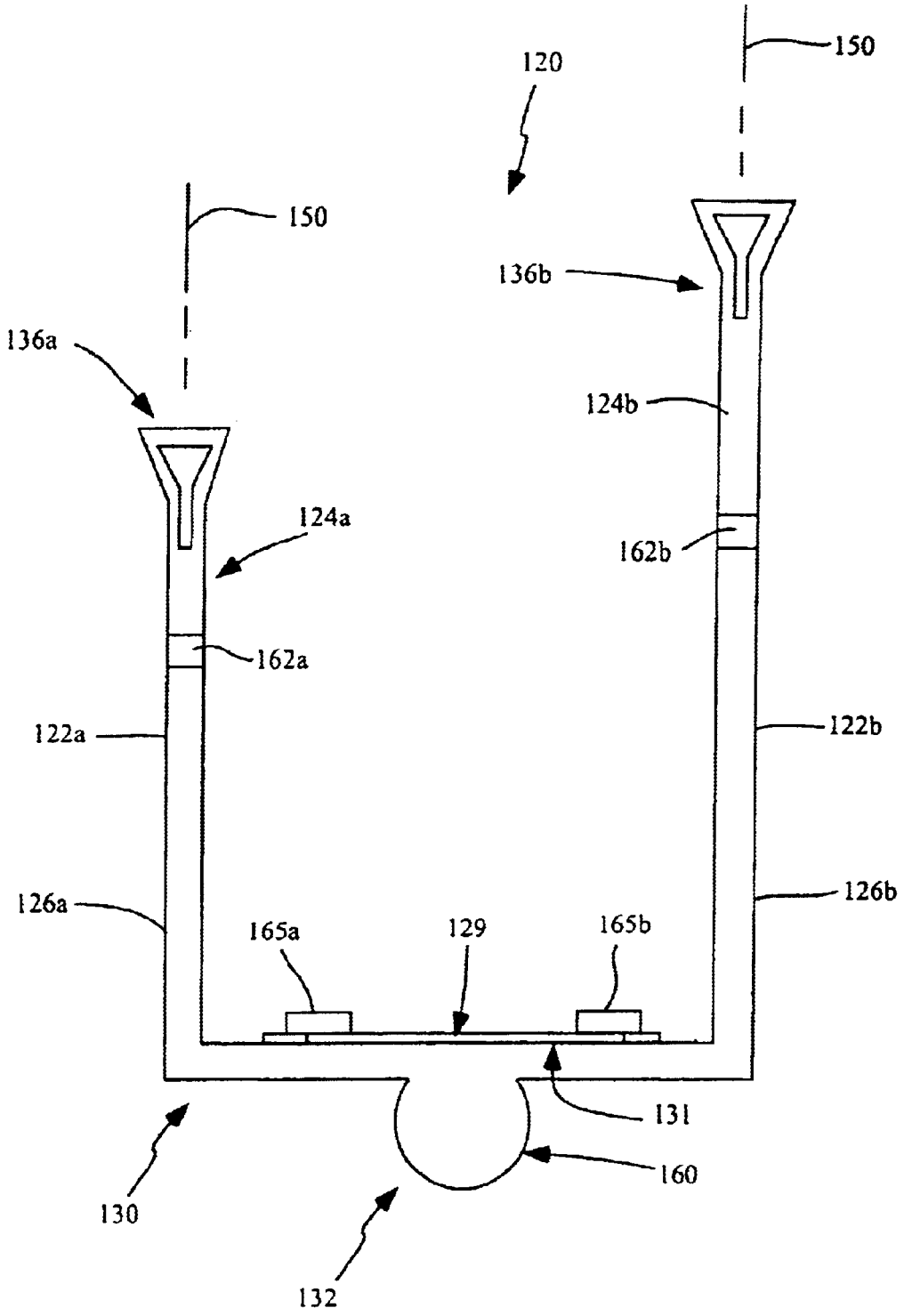

FIGS. 3A and 3B show simplified schematic drawings of two alternate embodiments of the novel apparatus 120 where the apparatus has a generally open square shape. In one embodiment, the base 130 and supports 122*a–b* are one continuous piece. Alternatively, the base is fixed with the supports 122*a–b* at the second ends 126*a–b* of the supports 122*a–b*. In the embodiments shown in FIGS. 3A and 3B, the compression resistance system 132 includes a generally spherical shaped member 160. The spherical member 160 is a gaseous filled ball having an internal pressure sufficient to resist compression. The spherical member 160 has sufficient flexibility to allow some degree of deformation and compression when a compression force 133 is applied while resisting the compression. For example, the spherical member can be a rubber ball like member. The compression resistance system 132 is secured with the base 130 at a center portion 129 of the base 130. The embodiments of the apparatus 120 shown in FIGS. 3A and 3B further include handles 136*a–b* which are generally triangular in shape with alternate orientations (pointing up in 3A and pointing down in 3B). The handles 136*a–b* are fixed with the supports at the first ends 124*a–b* of the supports 122*a–b*. The supports 122*a–b* are further configured to be adjustable along the axes 150 of the supports 122*a–b* to allow the handles 136*a–b* to be adjusted towards and away from the base for individual user preference. In embodiment, both the first and second supports 122*a–b* are constructed of two cooperating rods and/or beams where one fits within the other. The method for providing adjustments 162*a–b* can be substantially any type of method for adjusting including threaded screw mating between the two rods, spring button and whole adjustment and substantially any other means for adjustment. In one embodiment, additional support pieces can be added to the first and second supports 122*a–b* to increase the lengths.

In the embodiment shown in FIG. 3A, foot braces 164*a–b* are coupled with the base 130 to allow a user to insert his/her feet and remain in contact with the apparatus 120 during operation. In one embodiment, the foot braces are coupled with the support plate 131 allowing the user greater stability and control of the apparatus 120. Alternatively as shown in FIG. 3B, the base 130 includes clips 165*a–b* to allow a user to clip into the clips to secure the user to the base 130. In one embodiment, the user utilizes shoes with mating clips (not shown) to those clips 165 within the base. The clips 165 and mating clips are easily unclipped. For example, the mating clips are unclipped by providing a rotational force perpendicular to the support axis 150.

Figure 4:
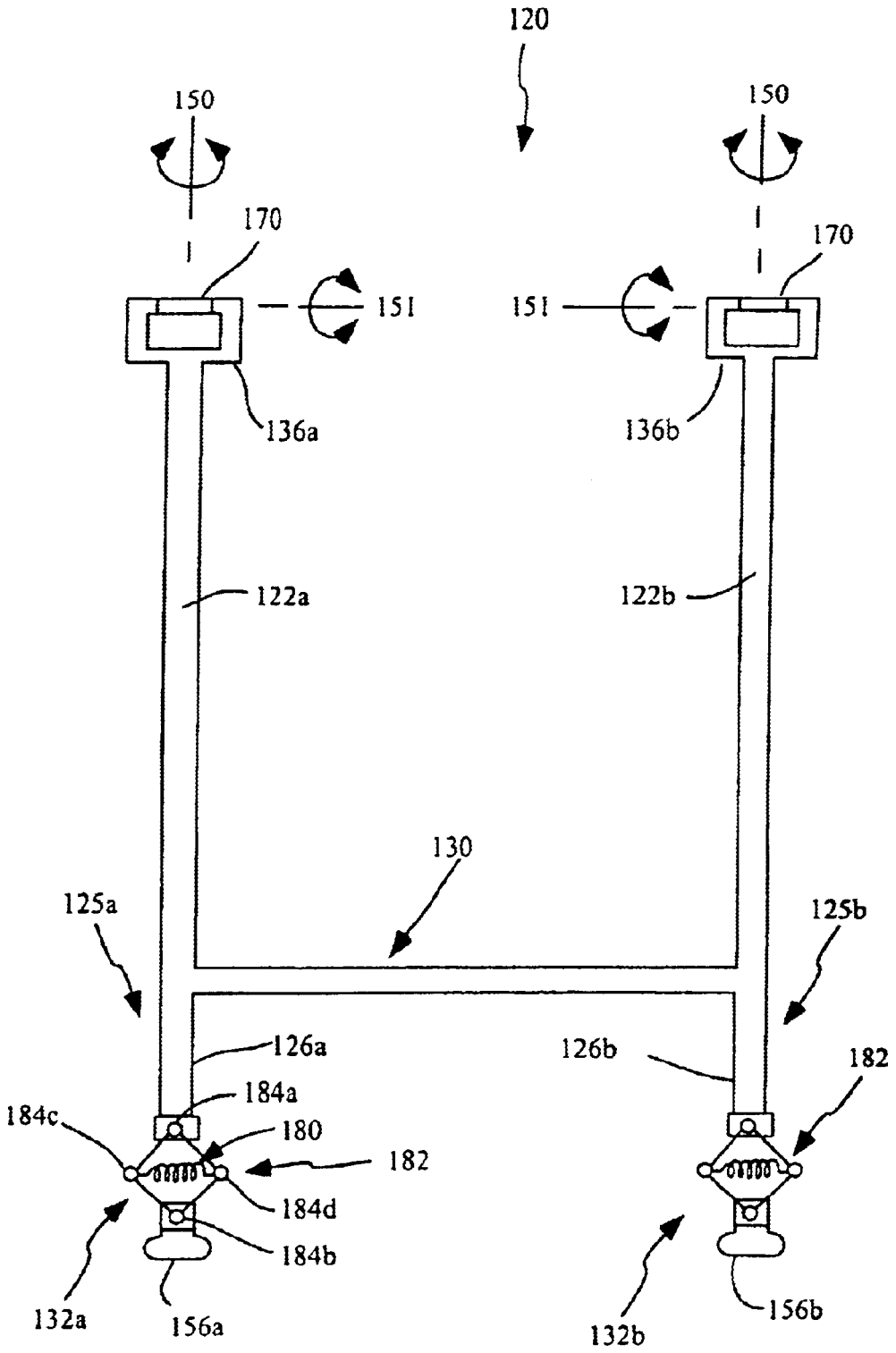
FIG. 4 shows a simplified schematic diagram of one implementation of one embodiment of the present apparatus where the apparatus is configured in a generally "H" shape.

FIG. 4 shows a simplified schematic diagram of one implementation of one embodiment of the present apparatus 120 where the apparatus is configured in a generally "H" shape. The apparatus 120 includes at least two compression resistance systems 132*a–b*. The first compression resistance system 132*a* couples with the second end 126*a* of the first support 122*a*, and a second compression resistance systems 132*b* couples with the second end 126*b* of the second support 122*b*. A base 130 couples with the first and second supports 122*a–b* proximate the second regions 125*a–b* of the first and second supports 122*a–b*. In the embodiment depicted in FIG. 4, the apparatus 120 includes generally rectangular or square shaped handles 136*a–b* rotationally coupled to the first and second supports 122*a–b*, respectively, allowing rotation of the handles 136*a–b* around the support axes 150. In one embodiment, handles 136*a–b* further include rotational sleeves 170. Rotational sleeves 170 are configured to be rotatable around an axis 151 that is perpendicular to the support axis 150.

In the embodiment shown in FIG. 4, the compression resistance system includes a spring 180 coupled with a hinge system 182. When a compression force is exerted on the apparatus 120 the hinge system 182 is compressed. The compression of the hinge system 182 results in a first hinge 184*a* and second hinge 184b being forced closer together and a third hinge 184*c* and fourth hinge 184*d* being forced away from each other. The spring 180 couples between the third and fourth hinges 184*c–d*. When the compression force is applied and the third and fourth hinges 184*c–d* are forced away from each other, the spring 180 is stretched. When the compression force is released, the spring 180 exerts a force on the third and fourth hinges 184*c–d* to pull the third and fourth hinges 184*c–d* back towards each other and force the first hinge 184*a* away from the second hinge 184*b*.

Figure 5A:
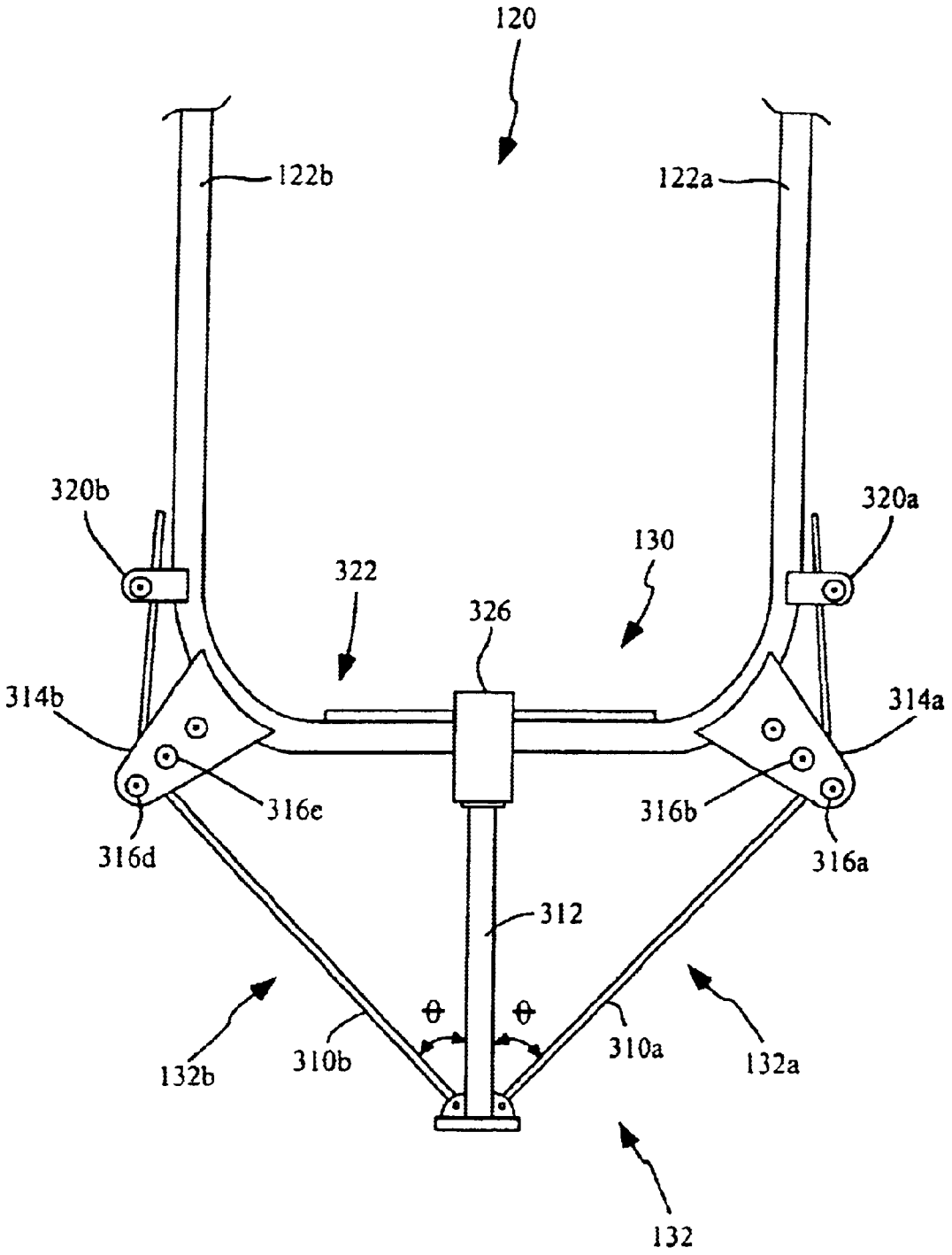
FIGS. 5A–C depict a simplified schematic diagram of one implementation of one embodiment of a compression resistance system.
Figure 5B:
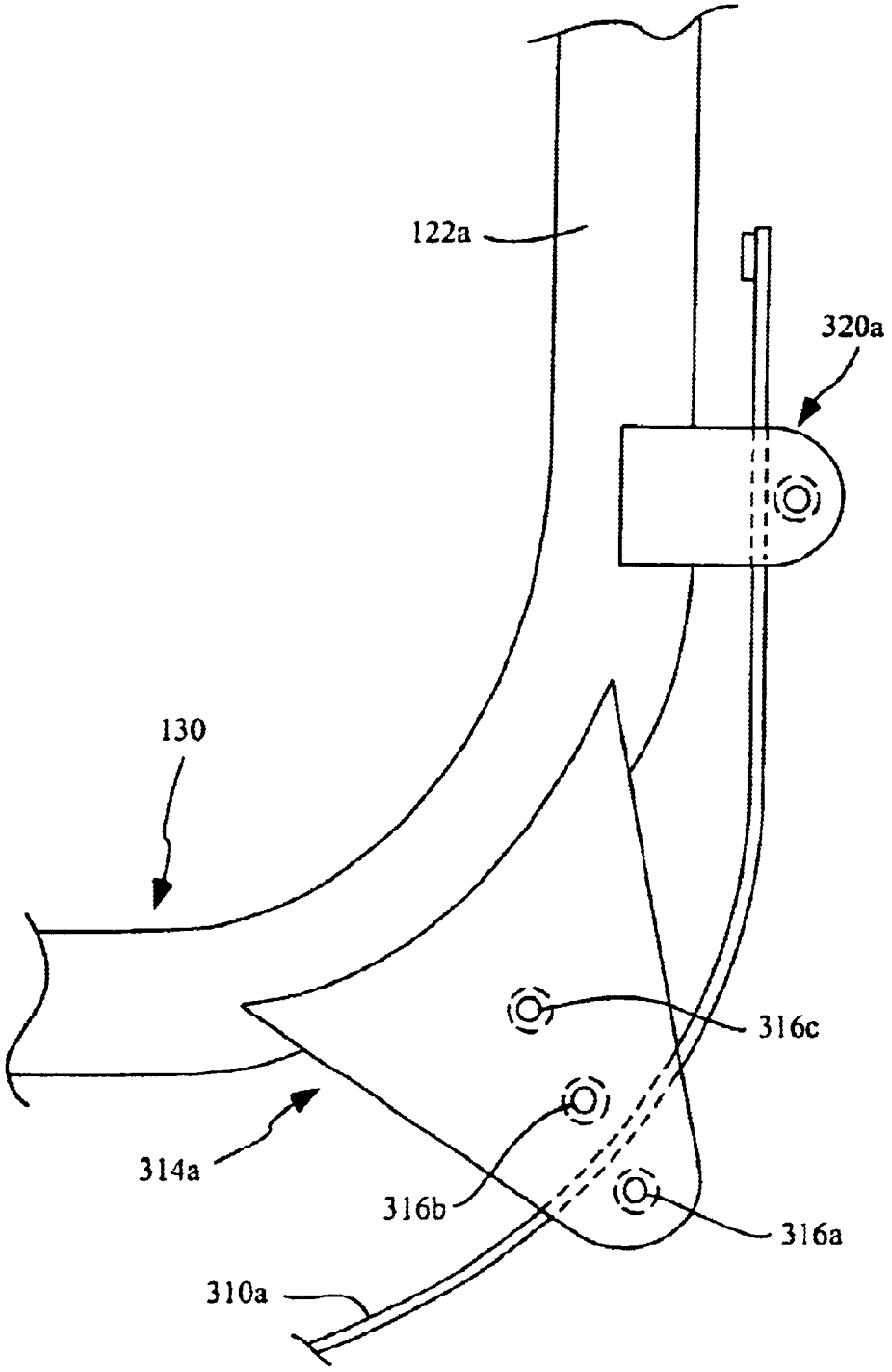
Figure 5C:
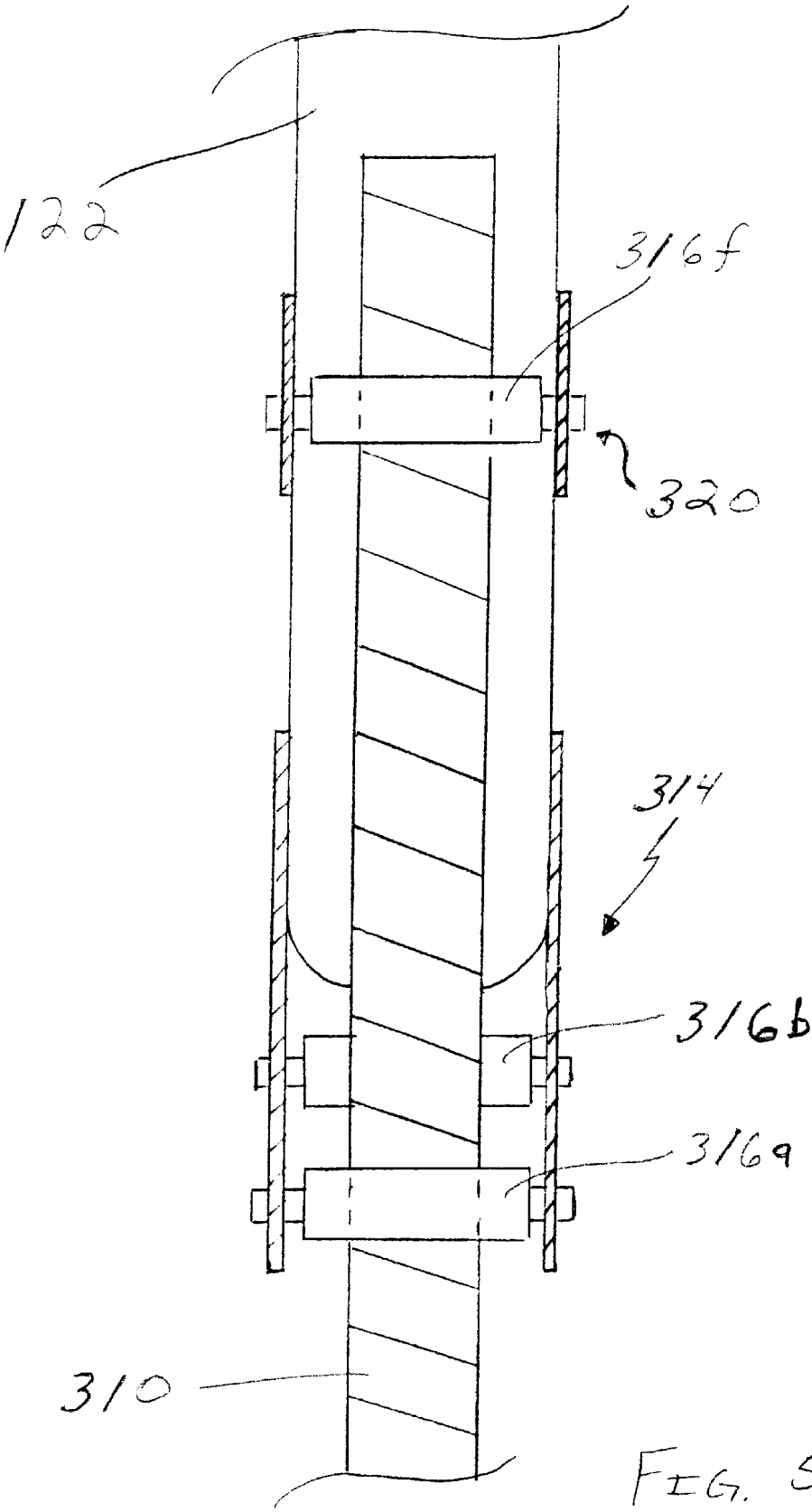

FIG. 5A depicts a schematic diagram of one implementation of one embodiment of a compression resistance system 132 which can be utilized in the apparatus 120. The compression resistance system 132 includes two substantially mirrored subsystems 132*a*, 132*b*. Each compression resistance subsystem 132*a–b* has one or more flex members 310*a–b*, respectively, coupled with a piston shaft 312. The flex members 310 each extend away from the piston shaft at an angle θ to a first roller engagement 314*a–b*. The first roller engagements 314*a–b* include at least one roller 316, and preferable more than one roller 316. In one embodiment, the flex member 310 extends through the first roller engagements 314*a–b* between two rollers 316*a–b* (and 316*d–e*). Each flex member 310*a–b* further engages a second roller engagement 320*a–b*. FIG. 5B shows an enlarged view of one side of the apparatus 120 showing the first and second roller engagements 314*a* and 320*a*. In this embodiment, the first roller engagement 314*a* is shown having three rollers 316*a–c*, although the first roller engagement 314*a* can include any number of rollers 316. The flex member 310*a* extends through the first roller engagement 314*a* and between two rollers 316*a–b*. The flex member further extends through the second roller engagement 320*a*. FIG. 5C shows a side view of the apparatus 120 showing the first roller engagements 314*a* with two rollers 316*a–b* with the flex member 310*a* positioned between the two rollers 316*a–b*, and the second roller engagement 320 with one roller 316*f*.

Still referring to FIGS. 5A–C, in operation, when a force, shown by the arrow labeled 322, is asserted on the apparatus, typically on the base 130 and/or handles 136 (not shown in FIGS. 5A–C), the base 130 and supports 122*a–b* are forced down causing a deflection of the flex members 310*a–b* as the rollers 316 roll along the flex members 310*a–b*. The flex members 310*a–b* are configured to resist deflection. When the force 322 on the base 130 is released, the flex members 310*a–b* force the base 130 and supports 122*a–b* to return to the initial position as the rollers 316 roll back along the flex members 310*a–b*. The flex member 310*a–b* are constructed of substantially any flexible material which resist flexing, including but not limited to steel, steel alloy, aluminum, aluminum alloy, carbon, titanium, plastic, and other such rigid but flexible materials. Additionally, the flex members 310 can be configured in different lengths and with different grades of material, such as more and less rigid, allowing a variation in the compression resistance provided by the flex member 310. The flex members can be replaced to allow different flex members of different compression resistance to be incorporated, or to replace worn or damaged flex members. The apparatus 120 can be configured with a plurality of flex members 310 on each side to increase the compression resistance. The rollers can be configured from substantially any material which resists wear and provide sufficient rigidity including but not limited to plastic, rubber, silicon and substantially any other material known in the art.

The first and second roller engagements 314*a–b* and 320*a–b*, respectively, are fixed to the base 130 and/or supports 122*a–b* through welding, bolding, riveting and substantially any other means for securing the engagements. By allowing the first roller engagement 314 to include a plurality of rollers 316, the flex members 310 can be adjusted between the plurality of rollers to increase and decrease the compression resistance provided by the compression resistance system 132.

Referring to FIG. 5A, the piston shaft 312 engages a cylinder 326. The cylinder is fixed to the base 130 through welding, screws, rivets and substantially any other means for securing. In one embodiment, the base 130 and cylinder 326 are formed from one continuous piece. The cylinder is configured to move along the piston shaft 312 as the compression force 322 is asserted and released to allow the base 130 and supports 122*a–b* to move up and down.

Figure 6B:
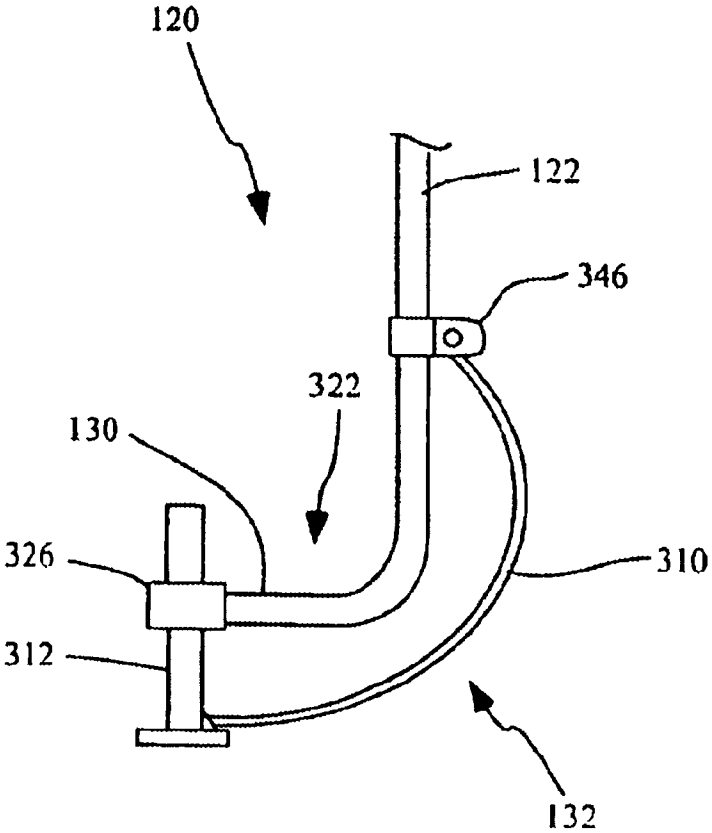
FIGS. 6A–B show a simplified schematic diagram of an alternate embodiment of the compression resistance system for the present apparatus.
Figure 6A:
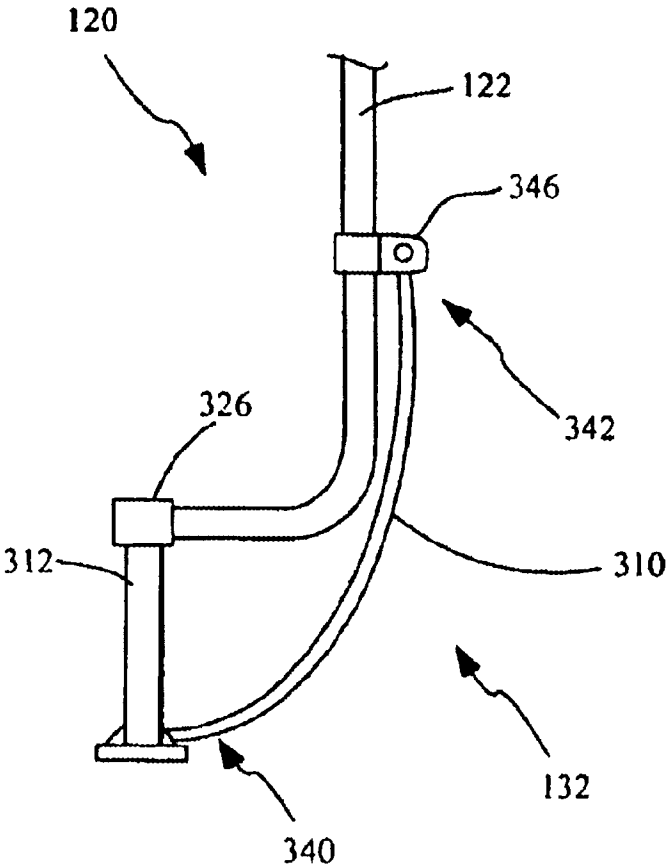

FIGS. 6A and 6B show a simplified schematic diagram of an alternate embodiment of the compression resistance system 132 for the apparatus 120. A flex member 310 is secured to a piston shaft 312 at a first end 340 of the flex member, and further secured to a securing mount 346 at a second end 342 of the flex member 310. When a compression force, indicated by the arrow labeled 322, is initiated on the base 130, the flex member 310 will deflect and bow out, as shown in FIG. 6B. When the compression force 322 is released, the flex member 310 will exert a decompression force returning the flex member 310 to an initial position, as shown in FIG. 6A, forcing the apparatus in the opposite direction as the compression force 322. In one embodiment, the securing mount 346 is adjustable along at least a portion of the length of the support 122. This allows the compression resistance force supplied by the flex member 310 to be increased or decreased. A plurality of flex members 310 can be utilized on each side of the piston shaft to allow an increase in the compression resistance.

Figure 7:
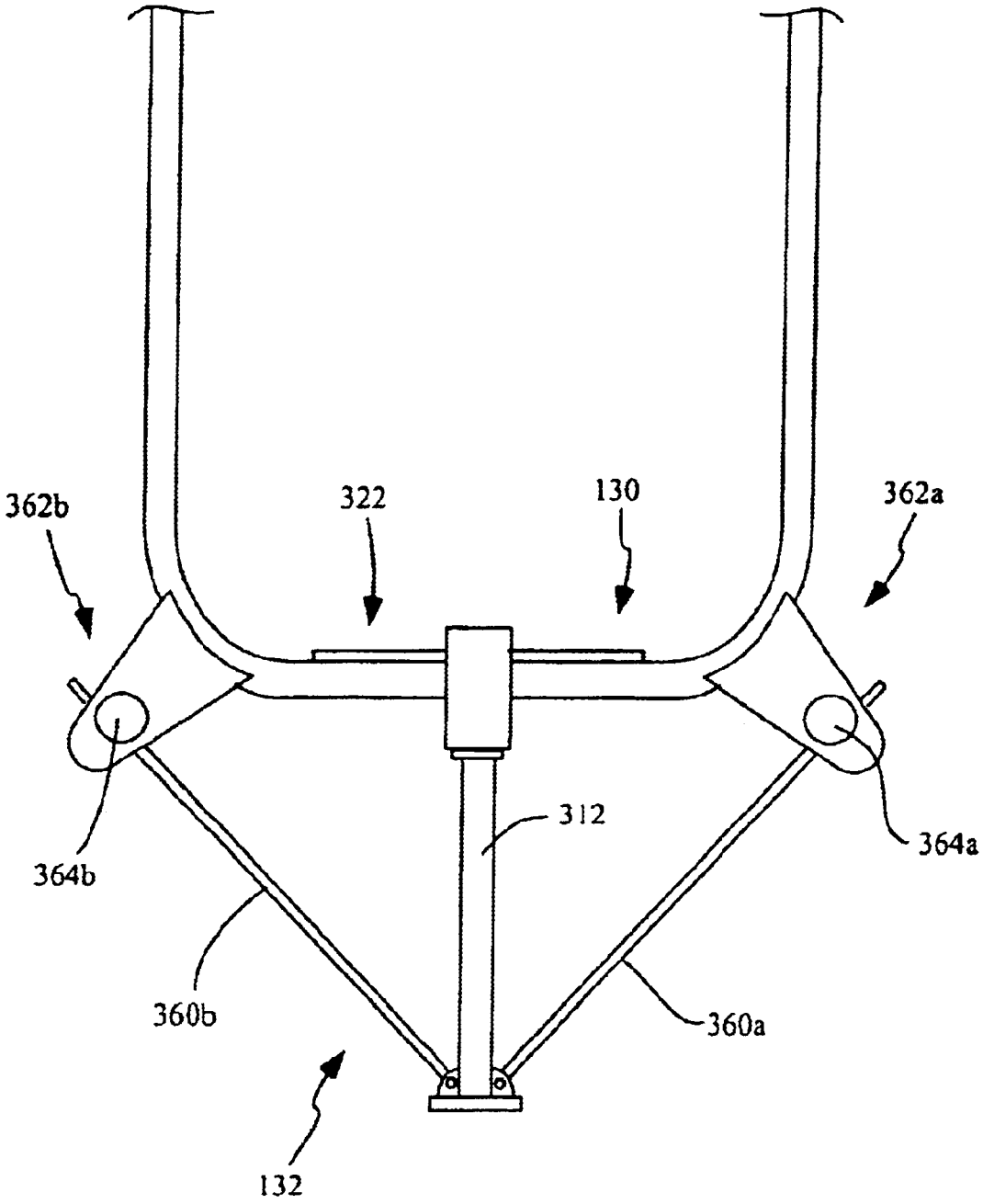
FIG. 7 shows a simplified schematic diagram of one implementation of one embodiment of the compression resistance system.

FIG. 7 shows a simplified schematic diagram of one implementation of one embodiment of the compression resistance system 132 where at least two rigid members 360*a–b* extend from a piston shaft 312. The rigid members each engage a torsion member 362*a–b*. The torsion members 362 include a torsion resistance element 364*a–b*. When the apparatus 120 is in operation, a compression force, indicated by the arrow labeled 322, is exerted on the base 130, the base and supports 122 will be forced in the direction of the compression force causing the torsion resistance elements 362*a–b* to travel along the rigid members 360*a–b* where the torsion resistance elements 362 will be twisted (or untwisted depending on the type of torsion resistance element employed). When the compression force 322 is released, the torsion resistance elements will untwist (or re-twist) to their original position traveling along the rigid members forcing the base 130 and supports 122*a–b* back up to their original position before the compression force 322 was applied. The torsion resistance elements can be implemented through substantially any device which provides torsion resistance including one or more springs, rubber, silicon and substantially any other torsion resistant element known in the art. The rigid members 360 can be made of substantially any material providing rigidity including, but not limited to, steel, steel alloy, aluminum, titanium, carbon, plastic and substantially any other material providing sufficient rigidity to apply the torsion force on the torsion resistance element 362.

One method of a user repetitively bouncing utilizing the present invention can include the following steps. The user stands on the base 130 between the first and second support 122*a–b*. The user maintains their balance prior to bouncing. The user provides a first force (i.e., the compression force 133) causing a compression of the compression resistance system 132. The first force is typically exerted in a generally downward direction adding to the force of gravity. The user releases or halts the first force, exerts a second force on at least one of the plurality of the handles 136*a–b* where the second force is in an opposite direction to the first force, and receives a third or lifting force provided by the uncompression force exerted by the compression resistance system 132 in the opposite direction as the first force. In one embodiment, the user leaves the ground upon exerting the second force and receiving the third force. The method then returns to the step where the user exerts the first force and then to the step to release the first force and exert the second force. In one embodiment, the present method of repetitively bounce allows the user to repetitively leave the ground to allow for the exertion of a superior or greater than the initially asserted first force.

Supports 122*a–b*, base 130, compression resistance system 132 and handles 136*a–b* are constructed of substantially any material providing sufficient structural rigidity and strength including plastic, aluminum, titanium, graphite, chromium alloy, steel, steel alloy, substantially any other material providing sufficient rigidity and strength and substantially any combination providing sufficient rigidity and strength. It will be apparent to one skilled in the art that that each element (i.e., supports 122*a–b*, base 130, compression resistance system 132 and handles 136*a–b*) can be constructed of one or more materials providing sufficient rigidity and strength, and that each of the element can be individually constructed of different materials than those of the other elements. For example, the supports 122*a–b* and base 130 may be formed of a aluminum, while the handles 136*a–b* are formed of a plastic, and the compression resistance system 132 is formed of a steel alloy, aluminum and plastic.

The apparatus 120 is superior to the standard pogostick because it reduces the potential for neck, chest and facial injury. The apparatus 120 replaces the single vertical support of the traditional pogostick aligned along the middle of the body with at least two supports 122*a–b* positioned on either side of the user's body during operation. The two support design of the apparatus 120 additionally allows for greater mobility than can be achieved with the standard pogostick. The apparatus additionally provides greater stability which allows a user to obtain a greater bounce. The apparatus 120 further allows the user to maintain a superior center of gravity than provided by the previous bounce systems.

The protection stopper 156 design allows users to gain balance more easily. This protection stopper 156 can allow users to rock while in a semi-stationary position. Further, the two independent handles 136*a–b* can be positioned in a plurality of positions to allow for a lower and more stable center of gravity. The implementations of adjustable and rotatable handles 136 allow users to custom fit the apparatus 120 for comfort, safety and style of use.

The open design of the novel apparatus 120 provides and promotes extreme motions which cannot be performed on the prior art device, such as rotating the novel apparatus 120 over the users head in flight. Adjustable handles and a more stable center of gravity also allow users to maintain balance while the apparatus 120 is tilted or at an angle.

The foregoing descriptions of specific embodiments and examples of the invention have been presented for the purpose of illustration and description, and although the invention has been illustrated by certain of the preceding examples, it is not to be construed as being limited thereby. They are not intended to be exhaustive or to limit the invention to the precise forms disclosed, and obviously many modifications, embodiments, and variations are possible in light of the above teaching. It is intended that the scope of the invention encompass the generic area as herein disclosed, and by the claims appended hereto and their equivalents. Having disclosed exemplary embodiments and the best mode, it will be apparent to one of ordinary skill in the art that many changes and modifications can be made thereto without departing from the spirit or scope of the appended claims.

What is claimed is:

1. A recreational apparatus, comprising:

a first support and a second support;

a base having a first end and a second end, wherein the first end of the base is fixed at a second region of the first support and the second end of the base is fixed at a second region of the second support; and a single compression resistance system secured with and supporting both the first support proximate a second end of the first support and the second support proximate a second end of the second support, wherein the compression resistance system is configured to provide an uncompression force;

wherein at a least a portion of the second region of the first support extends below the base, and at a least a portion of the second region of the second support extends below the base.

2. The recreational apparatus as claimed in claim 1, wherein:

the first and second supports are fixed with the base providing a distance between the first and second supports.

3. The recreational apparatus as claimed in claim 2, further comprising:

a first handle being secured with a first end of the first support, and a second handle being secured with a first end of the second support.

4. The recreational apparatus as claimed in claim 3, wherein:

the first and second handles include a compression locking system.

5. The recreational apparatus as claimed in claim 4, wherein:

the first and second handles are secured to the first and second supports, respectively, such that the first and second handles are rotatable.

6. The apparatus as claimed in claim 3, wherein the first and second handles are pivotably secured with the first and second supports, respectively, such that the first and second handles can be pivoted relative to the first and second supports.

7. The recreational apparatus as claimed in claim 2, wherein the compression resistance system is scalable.

8. A sports apparatus, comprising:

a base having a first end and a second end;

the first end of the base is coupled with a second region of a first support;

the second end of the base is coupled with a second region of a second support, wherein the first support and the second support are coupled with the base such that a first region of the first support is a distance from a first region of the second support; and a second end of the first support is coupled with a single compression resistance system and a second end of the second support is coupled with the single compression resistance system, wherein the single compression resistance system is configured to provide an uncompression force.

9. The apparatus of claim 8, wherein the compression resistance system is scalable.

10. The apparatus as claimed in claim 8, further comprising:

a first handle coupled with a first end of the first support, wherein the first handle is pivotable; and a second handle coupled with a first end of the second support, wherein the second handle is pivotable.

11. The apparatus of as claimed in claim 8, further comprising:

the compression resistance system being coupled with a protection stopper configured to provide an impact region for the apparatus and protect the compression resistance system.

12. The apparatus of claim 8, further comprising:

the first and second supports being positioned such that they angle away from the other for at least a portion of a length of each of the first and second supports at least in part establishing the distance between the first and second regions of the first and second supports.

* * * * *